US007398879B2

(12) United States Patent
Nottingham et al.

(10) Patent No.: US 7,398,879 B2
(45) **Date of Patent: *Jul. 15, 2008**

(54) PACKAGE WITH PRODUCT DEMONSTRATION FEATURE

(76) Inventors: John R. Nottingham, 19 E. Hanna Ln., Bratenahl, OH (US) 44108; John W. Spirk, 7890 Brigham Rd., Gates Mills, OH (US) 44040; John W. Nottingham, 43 Haskell Dr., Bratenahl, OH (US) 44108

( * ) Notice: Subject to any disclaimer, the term of this patent is extended or adjusted under 35 U.S.C. 154(b) by 253 days.

This patent is subject to a terminal disclaimer.

(21) Appl. No.: 11/247,457

(22) Filed: Oct. 11, 2005

(65) Prior Publication Data

US 2006/0076927 A1 Apr. 13, 2006

Related U.S. Application Data

(60) Provisional application No. 60/617,268, filed on Oct. 8, 2004.

(51) Int. Cl.

| | |
|---|---|
| ***B65D 85/00*** | (2006.01) |
| ***B65D 73/00*** | (2006.01) |
| ***B26B 19/12*** | (2006.01) |
| ***A45C 11/26*** | (2006.01) |

(52) U.S. Cl. ..... 206/349; 30/220; 206/471

(58) Field of Classification Search ..... 206/305, 206/320, 349–370, 461–471; 30/216–222
See application file for complete search history.

(56) References Cited

U.S. PATENT DOCUMENTS

| | | | | |
|---|---|---|---|---|
| 3,623,223 | A * | 11/1971 | Edgell | 30/220 |
| 5,379,895 | A * | 1/1995 | Foslien | 206/363 |
| 6,000,083 | A * | 12/1999 | Blaustein et al. | 15/28 |
| 6,189,693 | B1 * | 2/2001 | Blaustein et al. | 206/362.2 |
| 6,311,837 | B1 * | 11/2001 | Blaustein et al. | 206/362.2 |
| 6,371,294 | B1 * | 4/2002 | Blaustein et al. | 206/362.2 |
| 6,564,940 | B2 * | 5/2003 | Blaustein et al. | 206/362.2 |
| 6,932,216 | B2 * | 8/2005 | Blaustein et al. | 206/362.2 |
| 6,993,803 | B2 * | 2/2006 | Chan | 15/22.1 |
| 6,994,213 | B2 * | 2/2006 | Giard et al. | 206/363 |
| 7,094,981 | B2 * | 8/2006 | Sorrentino et al. | 206/362.2 |
| 7,213,709 | B2 * | 5/2007 | Moskovich et al. | 206/362.2 |
| 7,258,229 | B2 * | 8/2007 | Chan | 206/362.2 |
| 2008/0006549 | A1 * | 1/2008 | Chan | 206/361 |

* cited by examiner

*Primary Examiner*—Bryon P Gehman

(57) ABSTRACT

Disclosed is a package for containing a battery-powered device having both a power switch and a safety button, where both the power switch and the safety button must be actuated in order to turn the product on. The package has integral means to maintain the safety button in a depressed position, as well as means for a user to actuate the power switch while it is in the package in order to observe the operation of the device. Another embodiment package includes means to permit access to the safety button and a power switch of the device while the device is in the package in order to observe the operation of the device.

3 Claims, 7 Drawing Sheets

PACKAGE WITH PRODUCT DEMONSTRATION FEATURE

CROSS-REFERENCE TO RELATED APPLICATIONS

This application claims the benefit of U.S. Provisional Patent Application Ser. No. 60/617,268, filed Oct. 8, 2004.

BACKGROUND OF THE INVENTION

1. Field of the Invention

The present invention generally relates to product packaging. Specifically, the invention provides a package for a battery-powered product that allows a potential purchaser to momentarily turn the product on while it is in the package in order to observe the operation of the product.

2. Description of the Related Art

Various types of packages are used for packaging small articles of merchandise and displaying them in retail environments. A non-exhaustive list includes blister packages; cardboard, paper board, and plastic boxes and tubes; and plastic "clamshells." Many variations of these basic package types have been developed to address particular packaging needs.

In recent years, certain types of products have been packaged for sale in packages that allow a potential purchaser to demonstrate the product while it is still in the package. Such "try-me" packages provide a sales advantage over other types of packaging, since they allow shoppers to actually observe the operation of the product before purchasing it.

Among the products that have been packaged in such "try-me" packages are battery-powered devices having motors that are turned on by means of a switch on the product. "Try-me" packages for such products may incorporate a transparent, deformable "blister" or "clamshell" of thermoformed plastic or similar material. The shopper can actuate the power switch by pressing on the package, which deforms to allow the shopper to press the switch. Ideally, the blister or clamshell is made of a material that will spring back to its original contours when pressure is released.

There must be some means to prevent the switch from being left in the "on" position and draining the batteries in the device. One solution to this problem is to use a momentary contact switch that automatically returns to the "off" position when pressure on the switch is released.

Certain battery-powered products present a particular challenge for the use of "try-me" packaging. These are products that, because of safety concerns, have a separate safety-lock button that must be depressed before the power switch can be actuated to turn the device on. Two examples are a battery-powered grass shear and a battery-powered weed and grass trimmer. If a battery-powered grass shear is provided with such a safety-lock button to guard against accidental activation, merely allowing a user to press the power switch through the packaging will not be sufficient to turn the product on unless the package has some means for holding the safety-lock button in the depressed position or allowing the user access to the safety-lock button. No previously known package provides such a feature.

SUMMARY OF THE INVENTION

Accordingly, it is an object of the present invention to provide a package having integral means to hold a safety-lock button on a battery-powered device in the depressed position, as well as means for a potential purchaser to actuate the power switch of such a device while it is in the package in order to observe the operation of the device.

It is another object of the present invention to provide a package having means to permit access to a safety-lock button and a power switch of a battery-powered device while the device is in the package in order to observe the operation of the device.

What is disclosed is a package for containing a battery-powered device having both a power switch and a safety-lock button, where both the power switch and the safety-lock button must be actuated in order to turn the product on.

DETAILED DESCRIPTION OF THE INVENTION

Figure 1:
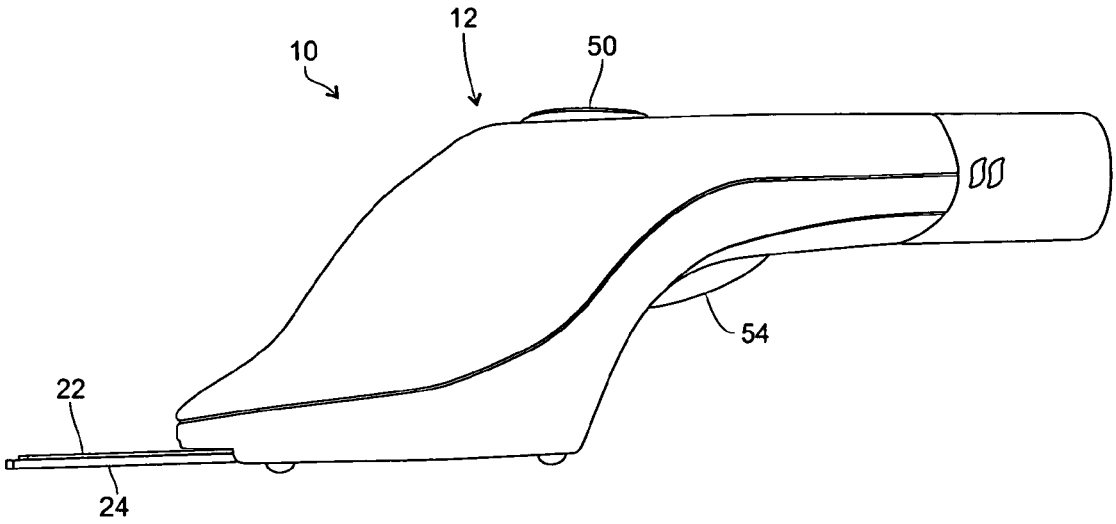
FIG. 1 is a side elevational view of a battery-powered grass shear.
Figure 2:
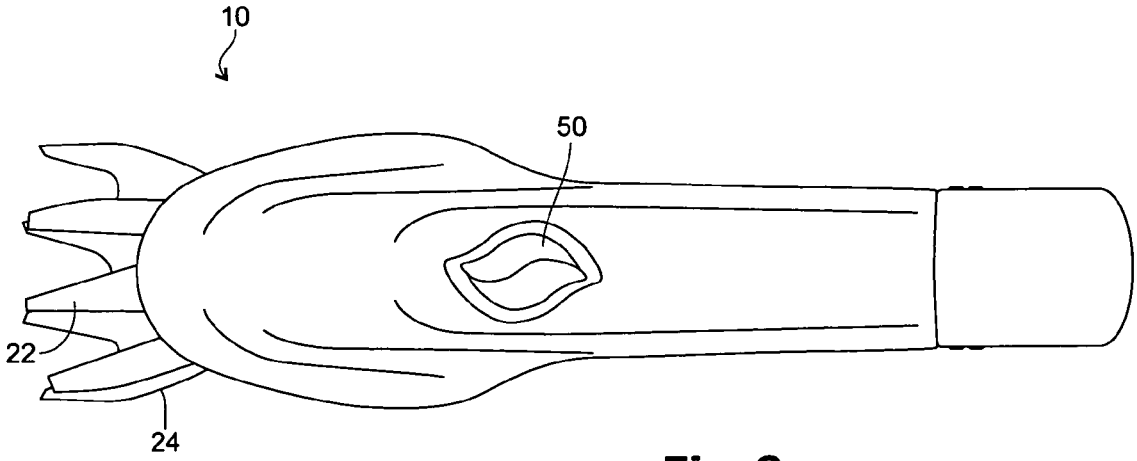
FIG. 2 is a top plan view of the battery-powered grass shear.

FIGS. 1 and 2 show a battery-powered grass shear generally designated as 10. Shear 10 is not part of the present invention, but is illustrated as an example of a type of product suitable for packaging in a package of the present invention. Shear 10 has a housing 12 designed to be held in a user's hand. Shear 10 includes blades 22 and 24. Disposed on the top of housing 12 is a push-button type power switch 50. For a product intended to be packaged in a package of the present invention, power switch 50 is ideally a momentary contact switch that springs up again when pressure on the switch is released. A safety button 54 is provided on the underside of housing 12, where it can be conveniently pressed by the index finger of a user grasping the shear 10. Shear 10 is designed such that safety button 54 must be pressed and held before power switch 50 can be actuated to turn on shear 10.

Figure 3:
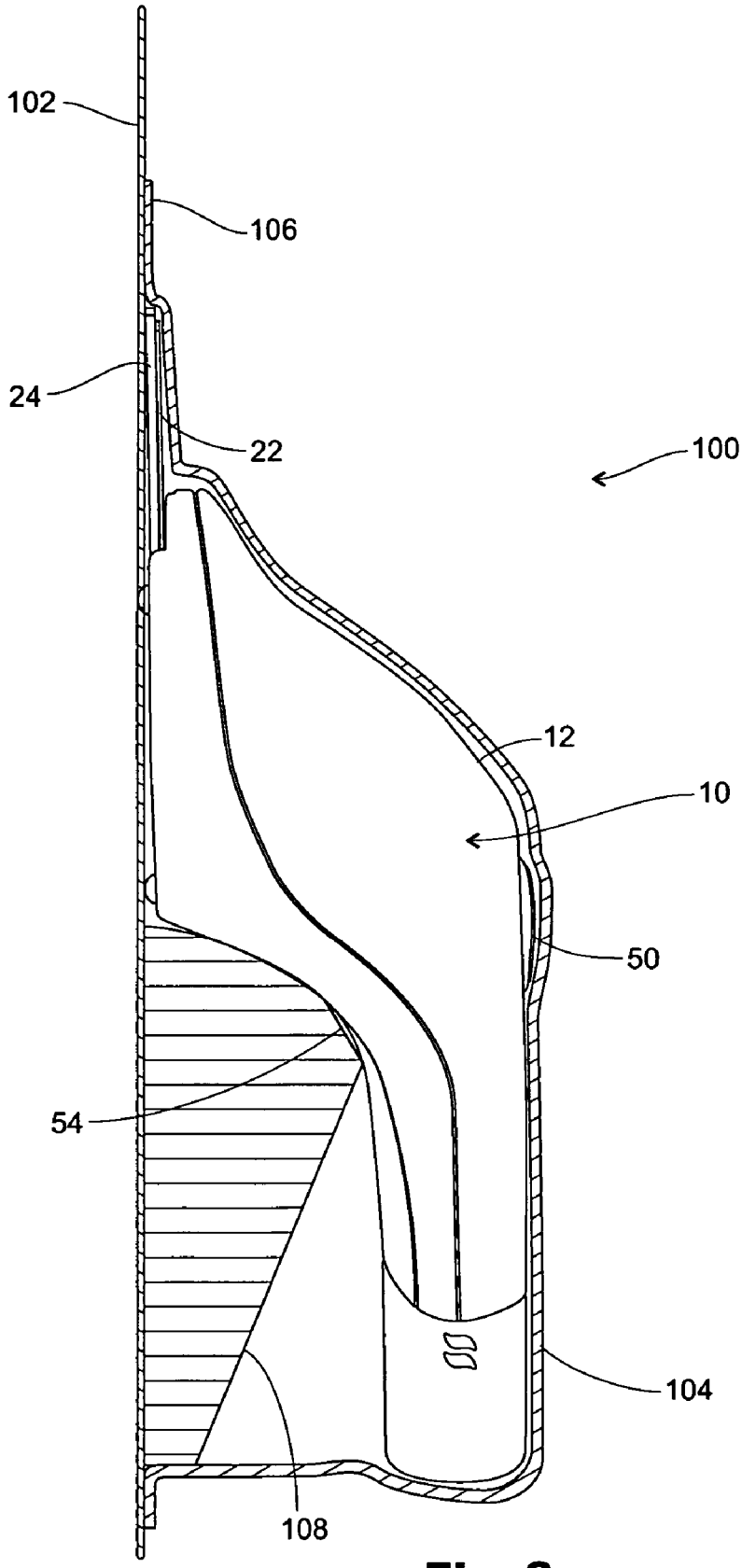
FIG. 3 is a side elevational view of the battery-powered grass shear in a sealed package of the present invention showing a cross section of the package.

FIG. 3 shows a package of the present invention containing a shear of the type illustrated in FIGS. 1 and 2. A package, generally designated as 100, comprises a backing card 102 and a transparent blister portion 104. Backing card 102 and blister portion 104 are manufactured using materials and methods well-known in the packaging art. Blister portion 104 is generally molded to conform to the top contours of shear 10 and has sidewalls dimensioned, so that when shear 10 is placed into the blister portion 104, the backing card 102 can be laid flat across the blister portion and bonded by means known in the art to a generally flat outer perimeter flange-like portion 106 of blister portion 104, such that shear 10 is held securely within blister portion 104 with minimal space to move. However, to facilitate the "try-me" feature, it is necessary that the part of blister portion 104 containing blades 22, 24 be wide enough to accommodate the full range of motion of blades 22, 24 in accordance with normal operation of shear 10.

The portion of blister portion 104 over power switch 50 must be pliable enough to permit a potential purchaser to press blister portion 104 down far enough to actuate power switch 50. Ideally, blister portion 104 is manufactured of a shape-retaining material that will spring back to its original contours after it has been pressed down to actuate power switch 50.

Since shear 10 is equipped with a safety button 54 that must be pressed in order to turn on the motor, a safety button block 108 is enclosed in package 100 between backing card 102 and shear housing 12. Safety button block 108 is preferably made of a relatively rigid, lightweight material, such as rigid plastic or foam, and is sized and shaped to fit securely between backing card 102 and housing 12 such that it holds safety button 54 in the depressed position while shear 10 is in package 100, thus allowing shoppers to turn on the motor by simply deforming the blister portion 104 above power switch 50 and pressing power switch 50. Once shear 10 is removed from package 100, safety button block 108 no longer presses against safety button 54 and shear 10 is restored to full functionality.

Figure 4:
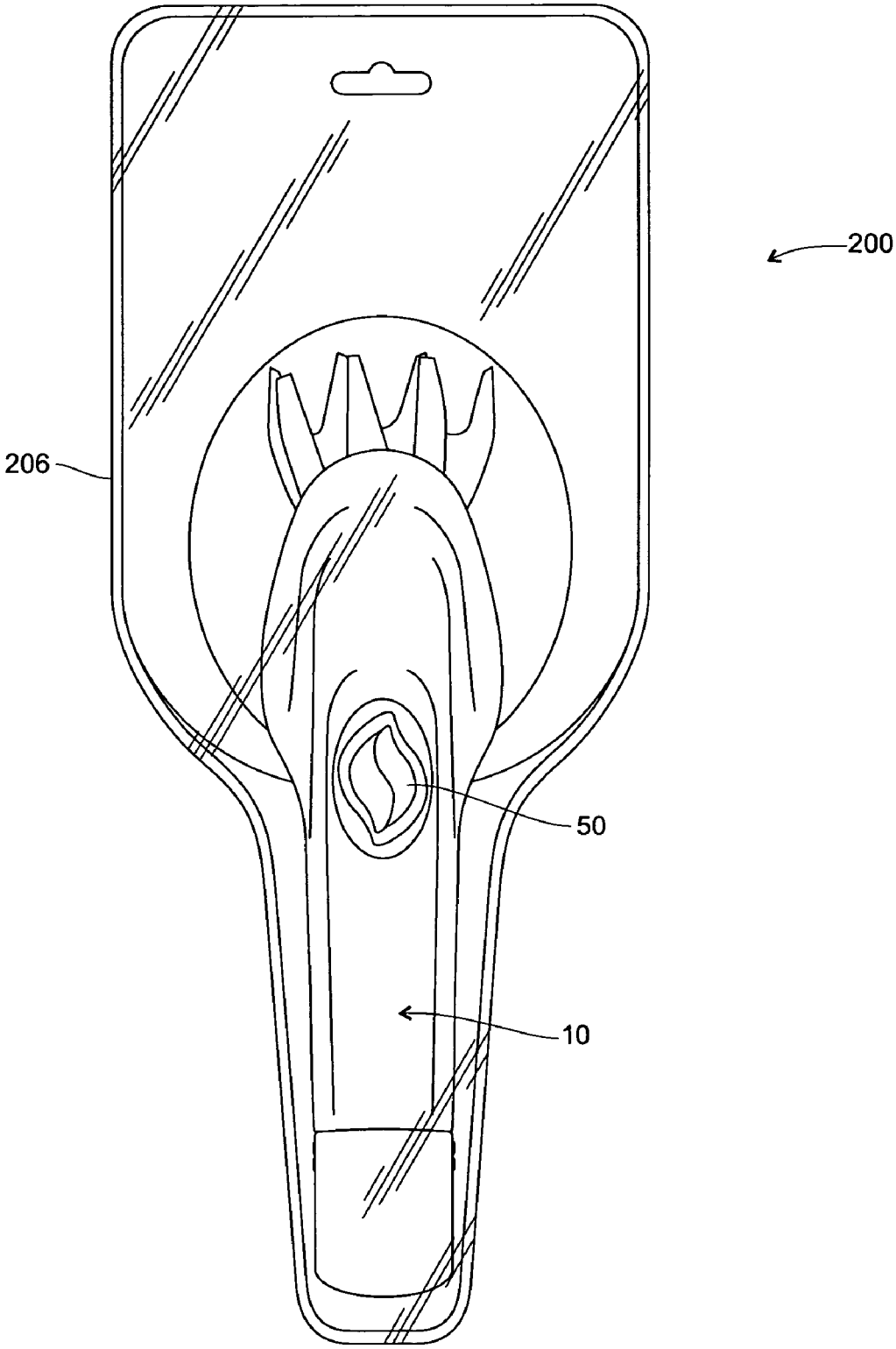
FIG. 4 is a top plan view of the battery-powered grass shear packaged in a second embodiment of a sealed package of the present invention.
Figure 5:
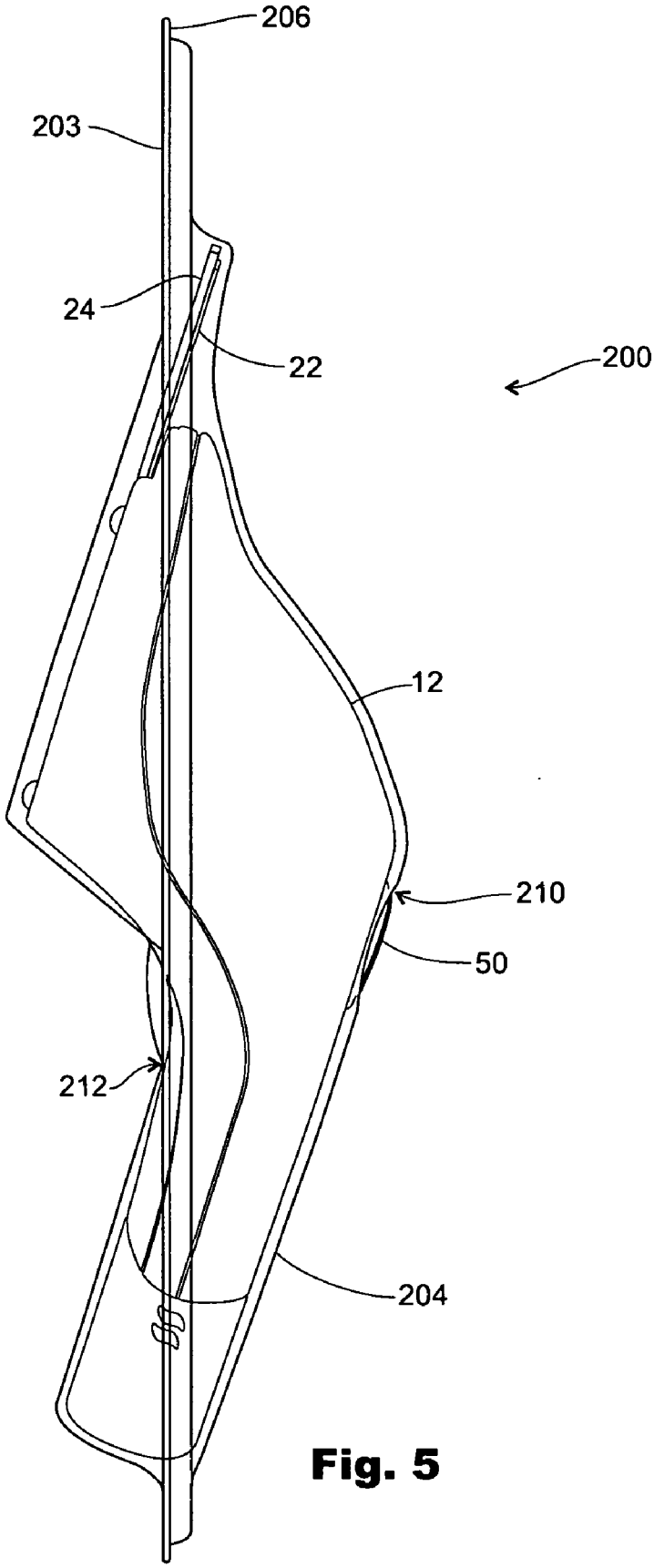
FIG. 5 is a side elevational view of the battery-powered grass shear packaged in the second embodiment of the sealed package of the present invention.
Figure 6:
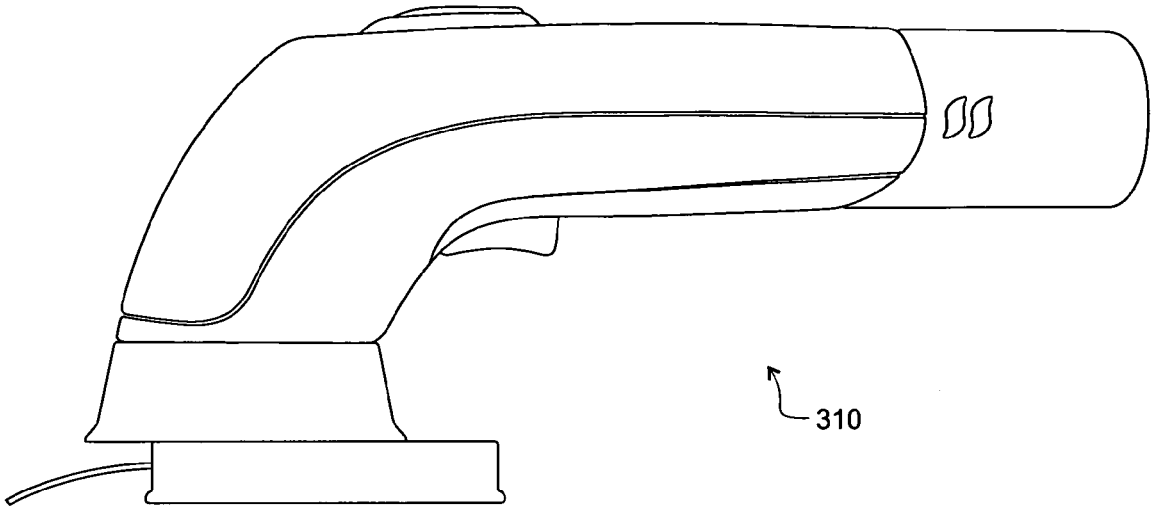
FIG. 6 is a side elevational view of a battery-powered weed and grass trimmer.
Figure 7:
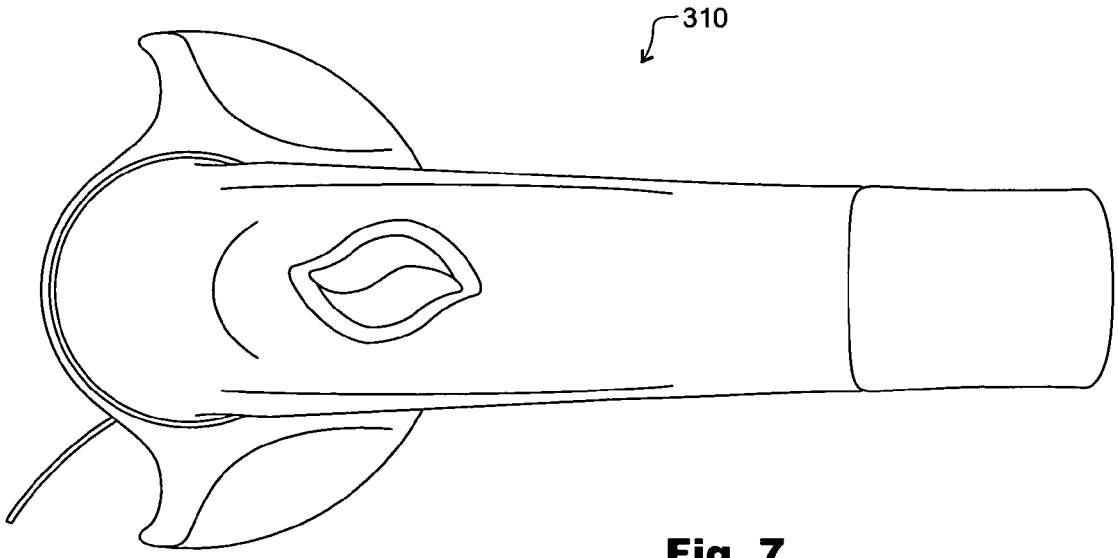
FIG. 7 is a top plan view of the battery-powered weed and grass trimmer.
Figure 8:
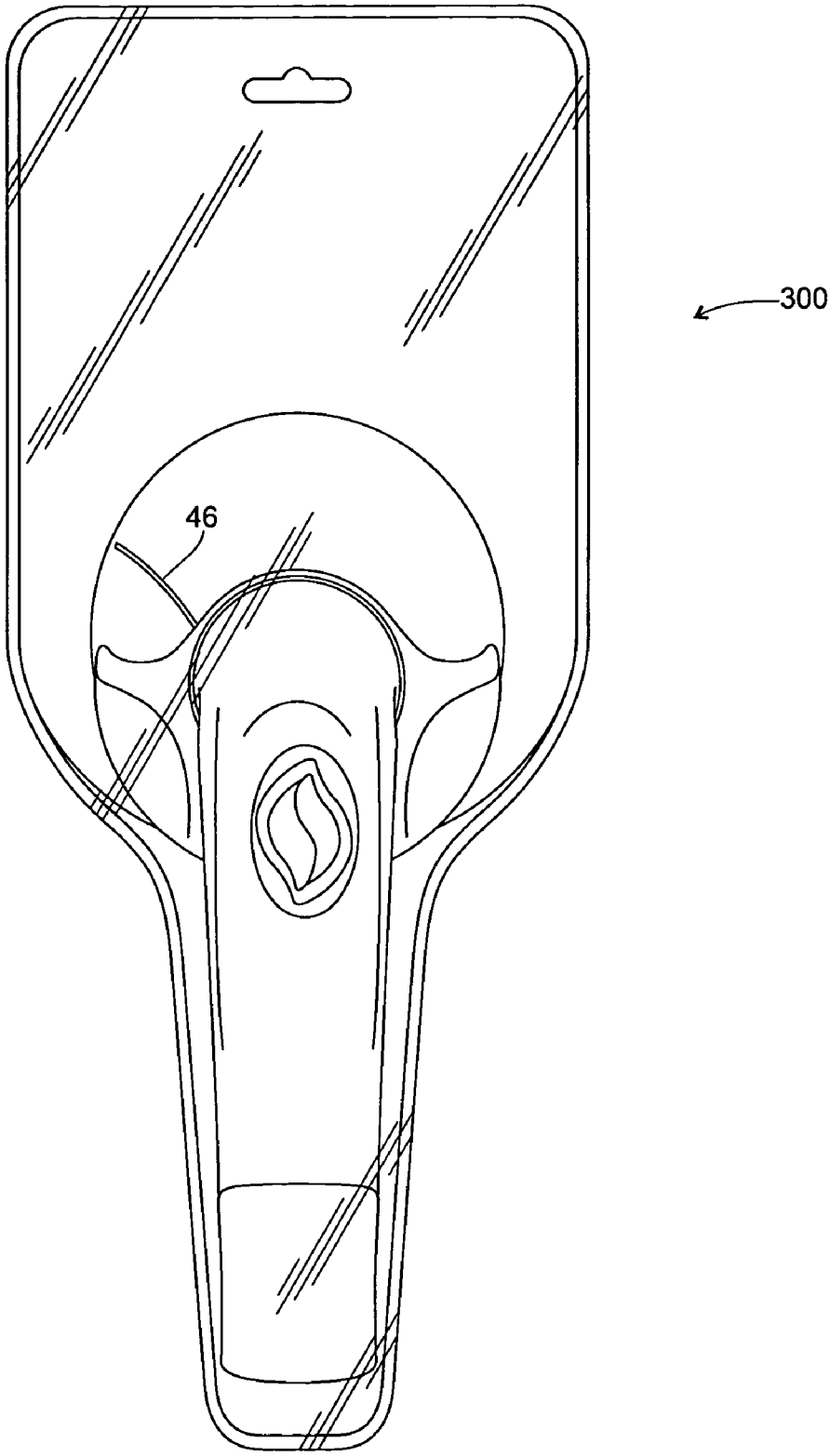
FIG. 8 is a top plan view of the battery-powered weed and grass trimmer packaged in a third embodiment of a sealed package of the present invention.
Figure 9:
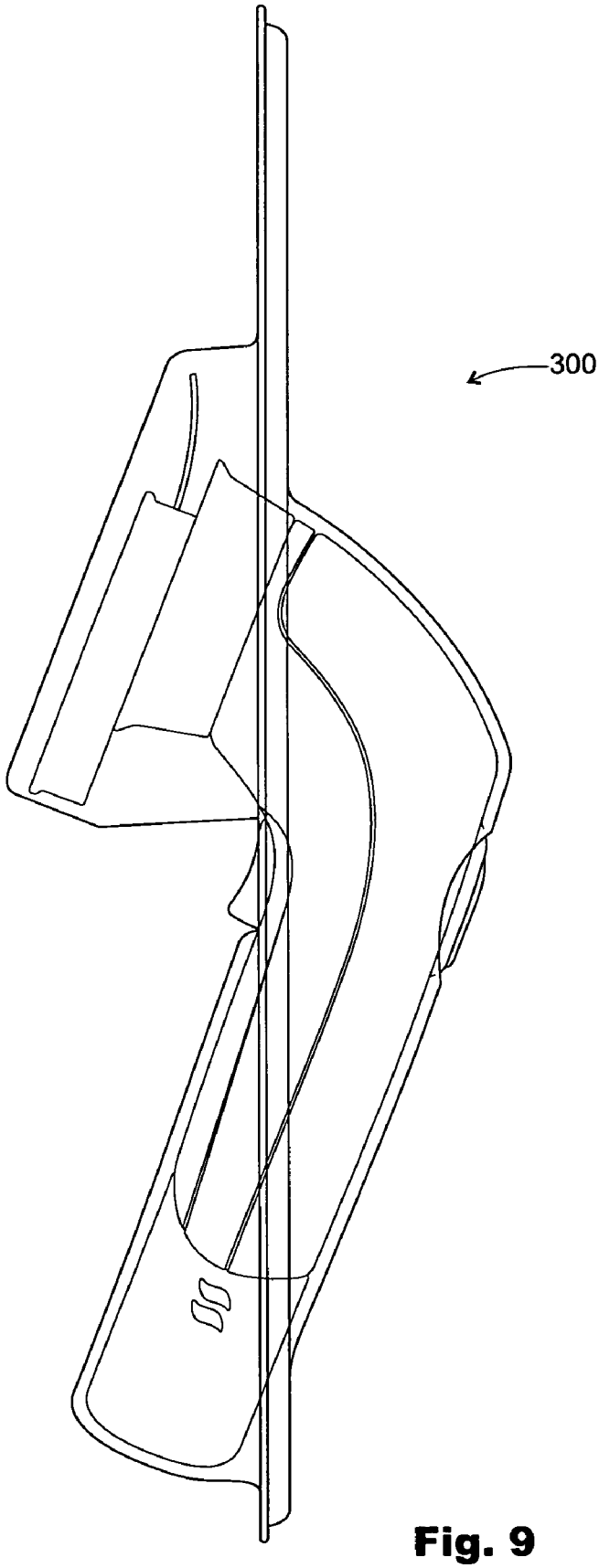
FIG. 9 is a side elevational view of the battery-powered weed and grass trimmer packaged in the third embodiment of the sealed package of the present invention.

FIGS. 4 and 5 show another embodiment of a package, generally designated as 200. Package 200 comprises a transparent front blister portion 204 and a transparent back blister portion 203. Front blister portion 204 and back blister portion 203 are manufactured using materials and methods well-known in the packaging art. Front and back blister portions 204, 203 are generally molded to conform to contours of shear 10. Front and back blister portions 204, 203 have sidewalls dimensioned so that when shear 10 is placed between the front and back blister portions 204, 203, the sidewalls are bonded by means known in the art to a generally flat outer perimeter flange-like portion 206 of package 200 such that shear 10 is held securely within package 200 with minimal space to move. However, to facilitate the "try-me" feature, it is necessary that the part of package 200 containing the blades 22, 24 be wide enough to accommodate the full range of motion of movable blade 22. A power switch opening 210 is positioned in front blister portion 204 to align with power switch 50 to permit a potential purchaser to press and actuate power switch 50. A safety opening 212 is positioned in back blister portion 203 to align with safety button 54 to permit a potential purchaser to press and actuate safety button 54.

FIGS. 6-9 illustrate a package 300 according to the present invention used with a weed and grass trimmer 310, which is similar to package 200.

In another embodiment (not shown), the present invention is manufactured as a "clamshell-type" package having two transparent thermoformed halves molded to conform generally to the contours of the product to be contained therein and joined by an integrally-molded hinge portion that allows the halves to be folded together around the product. The edges of the halves are then sealed by a process known in the art. In this embodiment of the present invention, the halves of the clamshell package are molded to securely hold the safety button block against the safety button in order to maintain the safety button in the depressed position. In an alternative embodiment of the clamshell design, the clamshell halves themselves are molded to hold the safety button in the depressed position, so no separate safety button block is required.

Those skilled in the art will appreciate that the above packages described above are only potential embodiments of such a "try-me" package. Other types of packaging may also be provided with such a "try-me" feature within the scope of the present invention and any appended hereto.

According to the provisions of the patent statutes, we have explained the principle, preferred construction, and mode of operation of the present invention, and have illustrated and described what we now consider to represent its best embodiments. However, it should be understood that within the scope of the appended claims and the foregoing description, the invention may be practiced otherwise than specifically illustrated and described.

What is claimed is:

1. A sealed package for containing a battery-powered device, wherein the battery-powered device comprises moveable components, a housing having both a push-button power switch that depends on momentary contact and a safety button that must be depressed in conjunction with the power switch to activate the moveable components, said package facilitates a trial of the contained device, said package comprising;

a means to allow a prospective purchaser to momentarily press the power switch while the device is in said package;

a means for constantly depressing the safety button while the device is in said package;

a backing card;

a blister portion conforming to top contours of the device, sidewalls of said blister portion are dimensioned to provide a means for said backing card to lay flat across said blister portion; and, a safety button block securely fit between said backing card and the housing, said safety block depresses the safety button in a depressed position for a time the device is contained within the package; wherein said blister portion provides minimal space for the housing to move within said package, said blister portion comprises a wide portion that provides the moveable components with a means for a full range of motion.

2. The package of claim 1, wherein said safety button block is a rigid, lightweight material selected from a group comprising:

foam; and, plastic.

3. The package of claim 1, wherein said blister portion is pliable in at least a region surrounding the power switch.

* * * * *